US010101114B2

(12) United States Patent
Hanken

(10) Patent No.: US 10,101,114 B2
(45) Date of Patent: Oct. 16, 2018

(54) SELF DEFENSE BRACELET AND ASSOCIATED SYSTEMS AND METHODS

(71) Applicant: Maleah Hanken, Cedar Rapids, IA (US)

(72) Inventor: Maleah Hanken, Cedar Rapids, IA (US)

(73) Assignee: Arma Accessories LLC, Ely, IA (US)

( * ) Notice: Subject to any disclaimer, the term of this patent is extended or adjusted under 35 U.S.C. 154(b) by 265 days.

(21) Appl. No.: 15/002,272

(22) Filed: Jan. 20, 2016

(65) Prior Publication Data

US 2016/0209160 A1 Jul. 21, 2016

Related U.S. Application Data

(60) Provisional application No. 62/105,478, filed on Jan. 20, 2015.

(51) Int. Cl.

| | |
|---|---|
| ***A63F 13/02*** | (2006.01) |
| ***A63F 1/18*** | (2006.01) |
| ***F41B 15/08*** | (2006.01) |

(52) U.S. Cl.
CPC ..... *F41B 15/08* (2013.01)

(58) Field of Classification Search
USPC ..... 463/47
See application file for complete search history.

(56) References Cited

U.S. PATENT DOCUMENTS

2013/0294005 A1* 11/2013 Garaycochea ..... F41H 13/0018 361/232

* cited by examiner

*Primary Examiner* — Pierre E Elisca
(74) *Attorney, Agent, or Firm* — Davis, Brown, Koehn, Shors & Roberts, P.C.; Matthew W. Coryell

(57) ABSTRACT

A self defense bracelet for a user comprising an ornamental defense member comprising at least one defensive protrusion configured to be used to protect the user; the ornamental defense member further defining at least one opening, configured to accept at least on finger of the user; and a strap member comprising a wearable region configured to be worn about a user's wrist.

6 Claims, 7 Drawing Sheets

Angel Wings 3

Angel Wings 2

Angel Wing 1

SELF DEFENSE BRACELET AND ASSOCIATED SYSTEMS AND METHODS

CROSS-REFERENCE TO RELATED APPLICATION(S)

This application claims priority to U.S. Provisional Application No. 62/105478 filed Jan. 20, 2015, which is incorporated herein by reference in its entirety for all purposes.

TECHNICAL FIELD

The disclosure relates to apparatus, systems and methods for self defense which is easily accessible in times of attack.

BACKGROUND

Each year many people are the victims of violent attacks. Many of these attacks are perpetrated in such a way that the victim has little time or freedom to defend themselves. There are many self defense devices available on the market, but these devices have limitations. Available self defense devices are often carried in a pocket, purse, or on a key chain which may result in the device being inaccessible if the need for self-defense arises suddenly such as when a person is subjected to a surprise attack. Further, self defense devices that are openly carried by a user may be obvious to an attacker who can then neutralize the device in the attack or may make others around the user uncomfortable if the device is perceived as a weapon. There is a need in the art for a self defense device that is readily accessible to the user but can be carried discretely so as not to be noticed by an attacker or others.

BRIEF SUMMARY

Discussed herein are various embodiments relating to wearable self defense apparatus, systems and methods. One example includes a self defense bracelet for a user, including an ornamental body including at least one defensive protrusion configured to be used to protect the user; and a wearable portion configured to be fitted around the wrist of the user, where the self defense bracelet is configured to be selectively positioned between a wearable position and a defensive position.

Implementations may include one or more of the following features. The self defense bracelet including at least two defensive protrusions further including sharpened points. The self defense bracelet where the ornamental body further includes at least one opening configured to accommodate at least one finger of the user. The self defense bracelet where the at least one opening is substantially heart shaped. The self defense bracelet where the ornamental body further includes a central recession. The self defense bracelet where the ornamental body further includes at least one adjacent recession. The self defense bracelet where the central recession and at least one adjacent recession are configured to accommodate the fingers of the user. In certain aspects, self defense bracelet includes at least two defensive protrusions further including sharpened points. In certain aspects, the ornamental body further includes at least one opening configured to accommodate at least one finger of the user. According to certain aspects, the ornamental body resembles angel wings. According to still further aspects, the ornamental body further includes a central recession. According to certain implementations of the self defense bracelet, the opening is substantially heart shaped. According to certain further implementations of self defense bracelet, the ornamental body is a bow. The self defense bracelet further including a first defensive protrusion including two sharpened points and a second defensive protrusion including two sharpened points. The self defense bracelet where the wearable portion is a strap. The self defense bracelet where the central recession, first adjacent recession and second adjacent recession are configured to accommodate the fingers of the user in the defensive position. The self defense bracelet where the wearable portion is a cuff The self defense bracelet where the ornamental body is substantially M-shaped.

One example includes a self defense bracelet including an ornamental body including a first end and a second end; at least one defensive protrusion disposed at the second end of the body and configured to be used to protect the user; and a wearable portion disposed at the first end of the body, the wearable portion being configured to be fitted around the wrist of the user, where the self defense bracelet is configured to be selectively positioned between a wearable position and a defensive position.

Implementations may include one or more of the following features. The self defense bracelet including at least two defensive protrusions further including sharpened points. The self defense bracelet where the ornamental body further includes at least one opening configured to accommodate at least one finger of the user. The self defense bracelet where the ornamental body is angel wings. The self defense bracelet where the ornamental body further includes a central recession, The self defense bracelet where the opening is substantially heart shaped. The self defense bracelet where the ornamental body is a bow. The self defense bracelet further including a first defensive protrusion including two sharpened points and a second defensive protrusion including two sharpened points. The self defense bracelet where the wearable portion is a strap. The self defense bracelet where the central recession, first adjacent recession and second adjacent recession are configured to accommodate the fingers of the user in the defensive position. The self defense bracelet where the wearable portion is a cuff. The self defense bracelet where the ornamental body is substantially M-shaped.

One example includes a self defense bracelet including: an ornamental body including: a first defensive protrusion including a first sharpened point; a second defensive protrusion including a second sharpened point; a central recession disposed between the first and second defensive protrusions; a first adjacent recession disposed opposite the first defensive protrusion; and a second adjacent recession disposed opposite the second defensive protrusion; and a wearable portion disposed adjacent to the first and second defensive protrusions, where the self defense bracelet is configured to be selectively positioned between a wearable position and a defensive position.

Implementations may include one or more of the following features. The self defense bracelet where the central recession, first adjacent recession and second adjacent recession are configured to accommodate the fingers of the user in the defensive position. The self defense bracelet where the wearable portion is a cuff. The self defense bracelet where the ornamental body is substantially M-shaped.

While multiple embodiments are disclosed, still other embodiments of the disclosure will become apparent to those skilled in the art from the following detailed description, which shows and describes illustrative embodiments of the disclosed apparatus, systems and methods. As will be realized, the disclosed apparatus, systems and methods are capable of modifications in various obvious aspects, all without departing from the spirit and scope of the disclosure. Accordingly, the drawings and detailed description are to be regarded as illustrative in nature and not restrictive.

Figure 1:
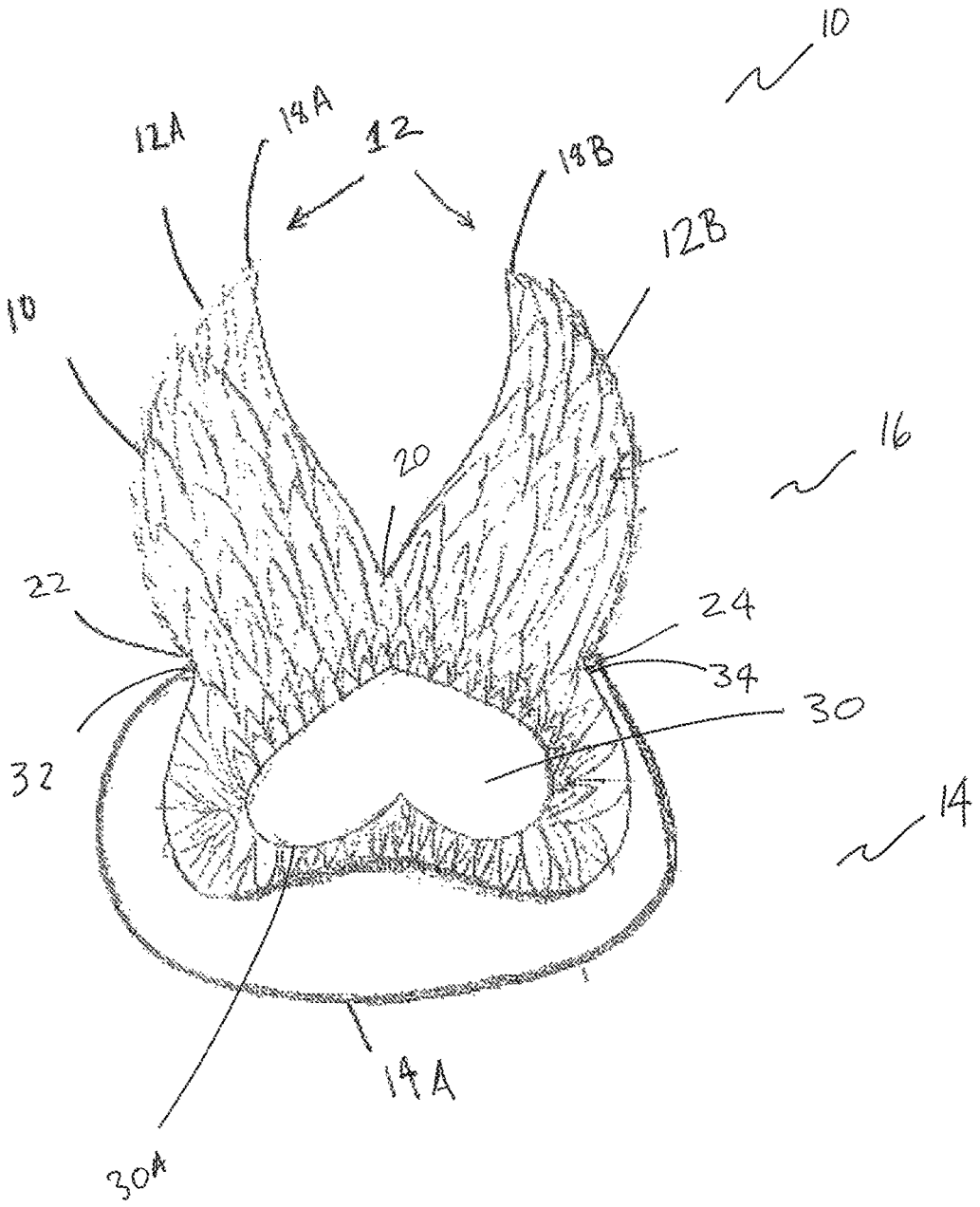
FIG. 1 is a top view of an exemplary embodiment of the bracelet, according to an exemplary embodiment.

FIG, 2 is a side view of the embodiment of FIG. 1, depicting the bracelet in use in a defense position.

Figure 3:
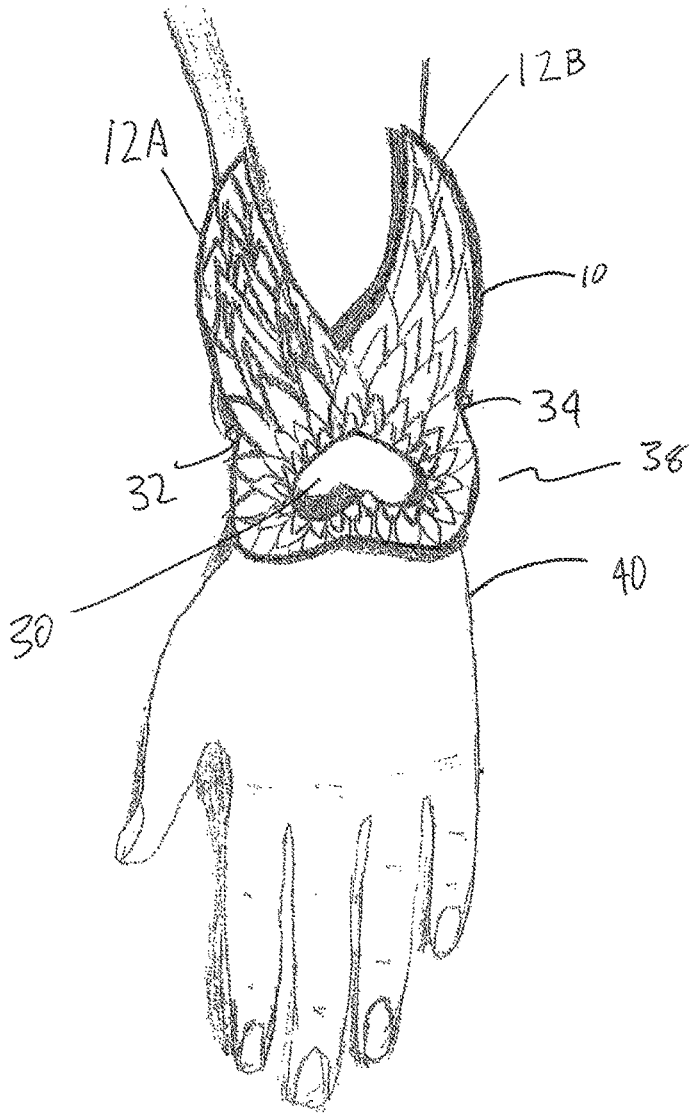

FIG. 3 is a top view of an exemplary embodiment of the bracelet, according to certain embodiments.

Figure 4:
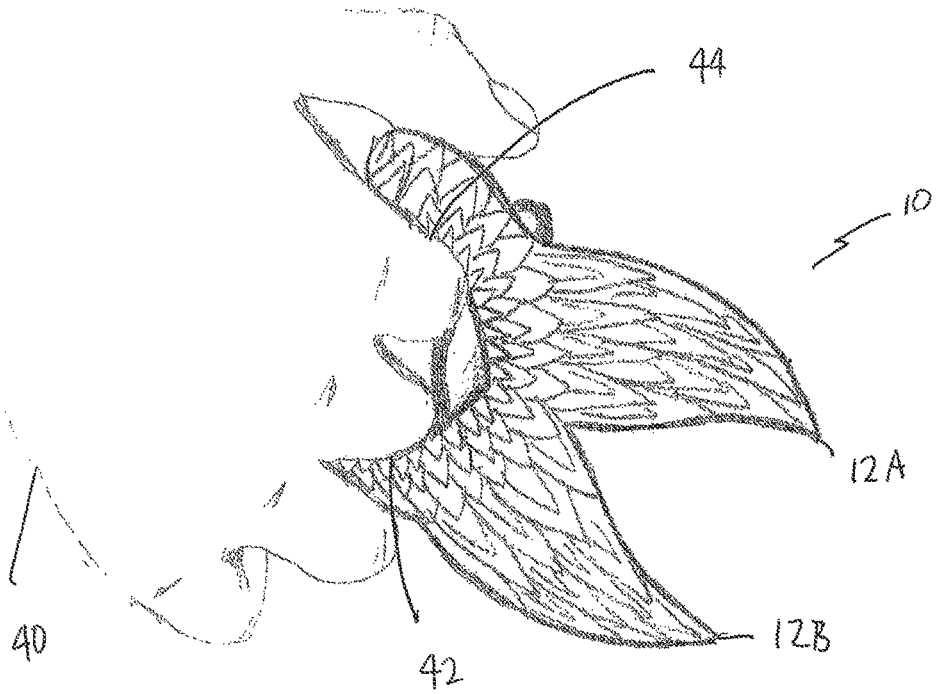

FIG. 4 top view of an exemplary embodiment of the bracelet, according to an exemplary embodiment.

Figure 5A:
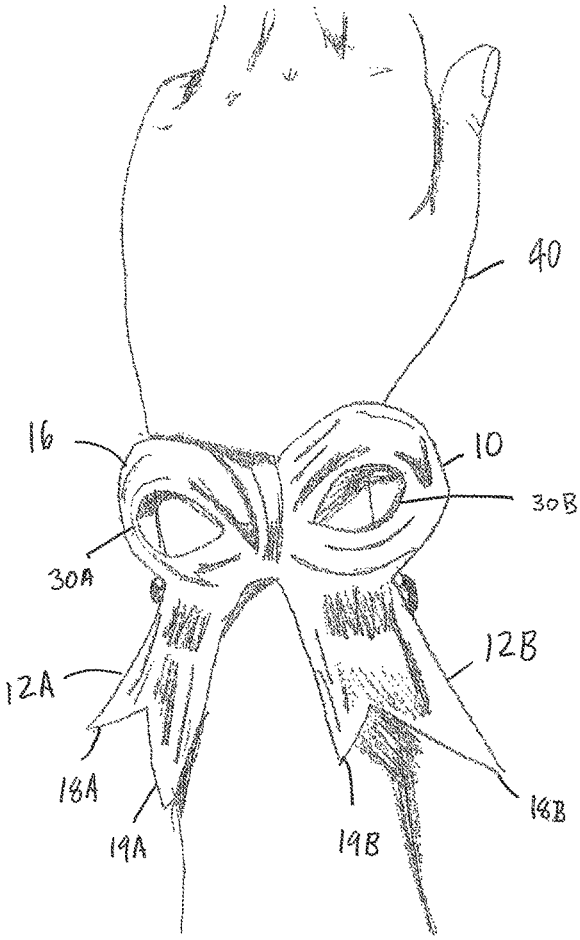

FIG. 5A is a is a top view of an exemplary embodiment of the bracelet, according to certain embodiments.

Figure 5B:
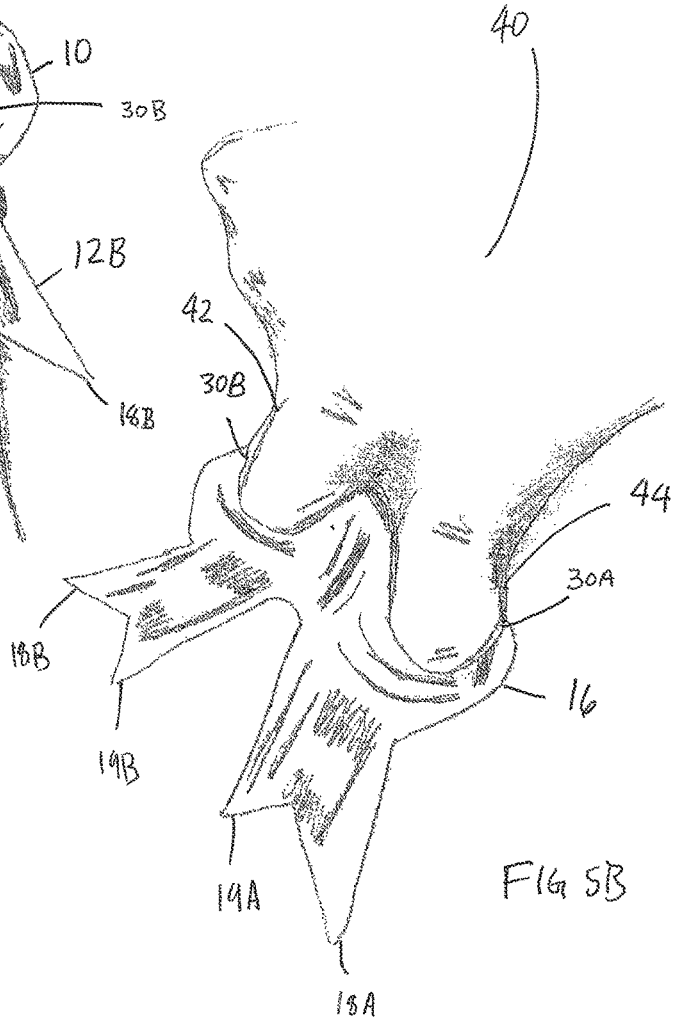

FIG. 5B is a top view of an exemplary embodiment of the bracelet, according to certain embodiments.

Figure 6A:
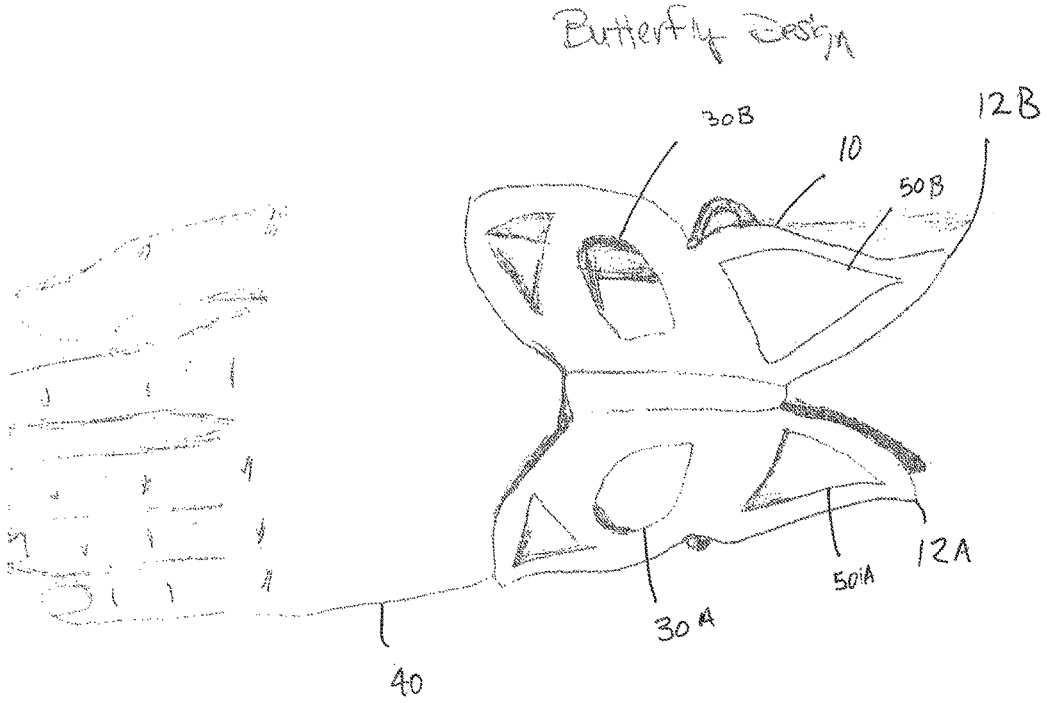

FIG. 6A is a is a top view of an exemplary embodiment of the bracelet, according to certain embodiments.

Figure 6B:
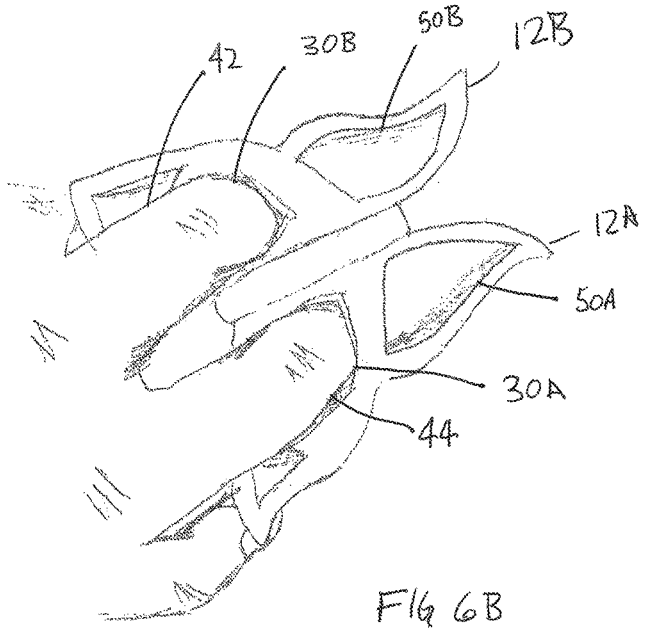

FIG. 6B is a top view of an exemplary embodiment of the bracelet, according to certain embodiments.

Figure 7:
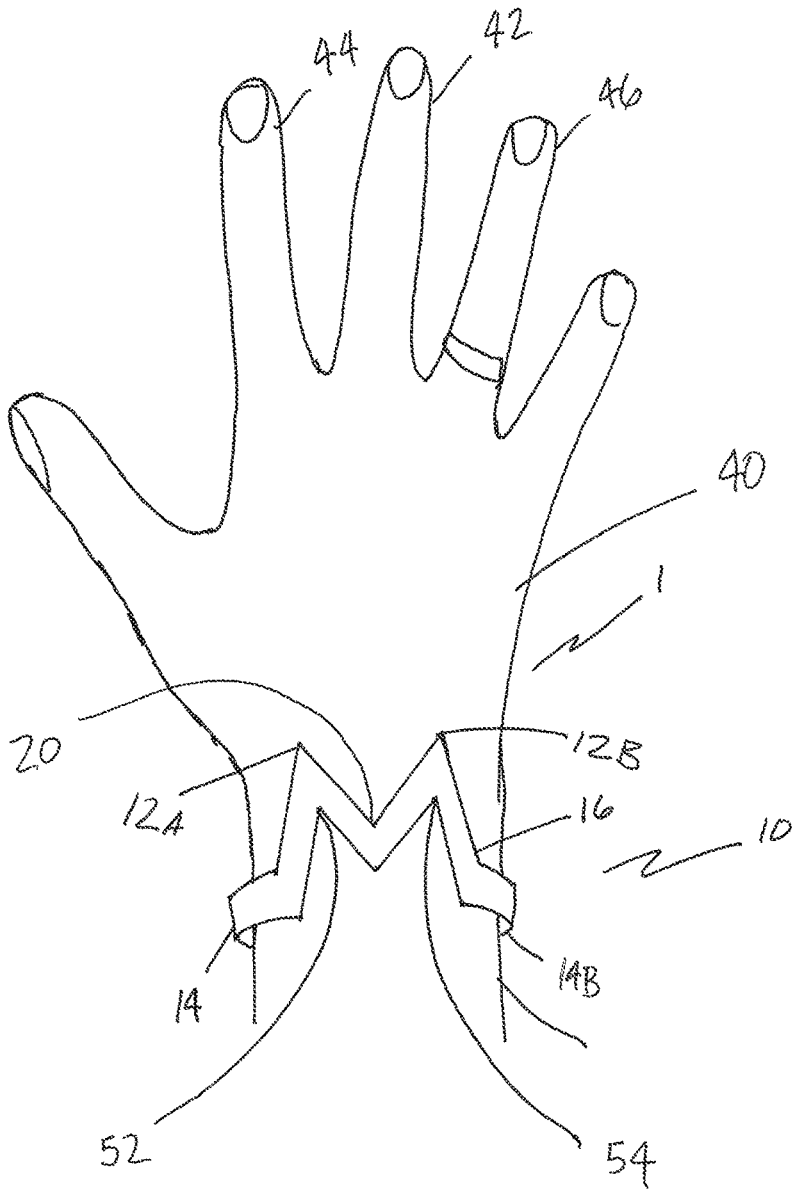

FIG. 7 is a top view of an alternate embodiment of e bracelet, according to certain embodiments.

DETAILED DESCRIPTION

As shown generally in FIGS. 1-7, the instant disclosure relates to apparatus, systems and methods for self defense, which in certain implementations is a bracelet 10. The disclosed bracelet 10 is configured to be capable of both a wearing state or position and a. defensive state or position, and to be easily or quickly moved from the wearing position to the defensive position. Typically, while in the wearing position, the bracelet 10 is worn as an attractive piece of jewelry, not readily identifiable to would-be attackers or others as a self defense device. However, when the user is attacked, the bracelet can be quickly deployed into the defensive position to ward off or defend against a potential attacker. in various exemplary embodiments, the bracelet 10 is styled, so as to provide a decorative aspect. In certain embodiments, this decorative aspect can be styled as "angel wings" (FIGS. 1-4), as a "bow" (FIGS. 5A-5B), as a "butterfly" (FIGS. 6A-6B), "cuff" (FIG. 7) or the like. In these embodiments, various configurations of certain features, such as the protrusions 12 and openings 30 can be adjusted to accommodate stylistic preferences and maintain functionality.

Turning to the drawings in greater detail, FIG. 1 depicts an embodiment of the wearable self defense bracelet 10, which for brevity will be referred to herein as a bracelet 10. In the implementation of FIG. 1, the bracelet 10 has at least one defensive protrusion 12, a wearable portion 14 and an ornamental defense member, or body 16. In various implementations, the wearable portion 14 is adapted to be fitted around the wearer's wrist and the body 16 is both decorative and configured or otherwise adapted to be used in a self defense situation, as described herein. In the implementation of FIG. 1, the body 16 features a self defense portion (represented generally at the defensive protrusions 12). As will be apparent from the various implementations disclosed herein, the defensive protrusions 12 are configured to provide a system and method for non-lethal or less-lethal defense.

In the implementation of FIG. 1, a first defensive protrusion 12A and second defensive protrusion 12B are provided, extending distally from the body 16. In certain embodiments, the defensive protrusions 12A, 12B are elongate and tapered distally to form sharp points 18A, 18B. With the defensive protrusions 12A, 12B, a wearer or user is therefore able to ward off attack by quickly removing the bracelet 10 and thrusting the sharpened points 18A, 18B into an attacker. In various implementations, the sharpened points 18A, 18B are sufficiently sharp to provide a non-lethal or less-lethal defense, so as to injure and deter an attacker when thrust into the attacker by the user but not so sharp so as to risk injury to the user when wearing the bracelet 10.

Continuing with FIG. 1, in various embodiments, the defensive protrusions 12A, 12B are tapered portions of the body 16 around a central recession 20, with external recesses 22, 24 being disposed on either side of the body 16.

As is also shown in FIG. 1, in certain embodiments, the body 16 has at least one opening 30, which is configured to accommodate the fingers of the user in use (as is shown in FIG. 4). According to certain embodiments, the opening 30 is a substantially heart shaped opening 30A. The heart shaped opening 30 provides an aesthetically pleasing design feature, thus enhancing the overall appearance of the bracelet 10 as jewelry, while also providing the ability to grip the bracelet 10 with two fingers when in use for self defense purposes (as discussed further in reference to FIG. 4). In various alternate implementations, other configurations are possible.

Figure 2:
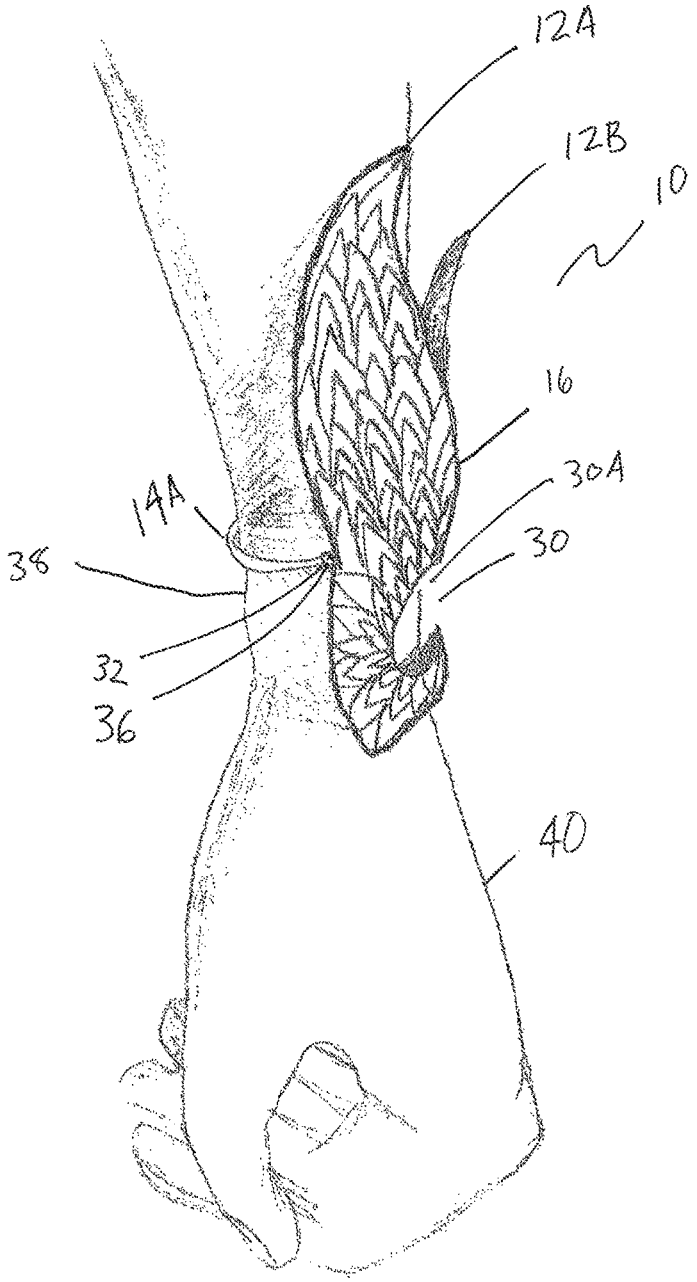

As best shown in FIGS. 2-3, in certain embodiments the wearable portion 14 is strap member 14A configured to be worn around the user's wrist 38. Accordingly, in certain embodiments, the wearable portion 14 features a strap member 14A or attachment portion, which is fixedly attached to the body 16 of the bracelet 10 at one or more attachment points (also shown at FIG. 1 at 32, 34). In certain embodiments, these attachment points 32, 34 are adapted so that the strap member 14A can be detached quickly to allow the user quick access to the bracelet 10 for defense. For example, as shown in FIG. 2, a clasp 36 or other well-known attachment can be provided at the attachment points 32, 34.

As is further shown in FIGS. 2-3, the bracelet may be worn such that the defensive protrusions 12A, 12B are oriented away from the user's hand 40, or in the opposite direction (as shown in FIG. 7, for example). In use, and as shown for example in FIGS. 2-3, in exemplary embodiments, the bracelet is typically worn about the user's wrist 38 in a decorative and protected fashion, such that the at least one defense protrusion 12A, 12B is oriented toward the user's body (not shown). In these embodiments, when the user is under attack, the bracelet may be quickly turned about and fitted around the user's fingers 42, 44 by way of the opening or openings 30, such that the defensive protrusions 12A and 12B are ready for use to defend the user.

Turning to FIG. 4, in certain implementations, the opening 30 is configured to accommodate a user's fingers 42, 44 when in the defensive position, such that the defensive protrusions 12A, 12B are oriented away from the user's hand 40 and capable of being used against a potential attacker.

As best shown in FIGS. 5A-B and 6A-B, in alternate implementations two openings 30A and 30B are provided, such that each opening can accommodate a finger 42, 44 of the user (as shown in FIGS. 5B and 6B) when in the defensive position.

Continuing with FIGS. 5A-B, the defensive protrusions 12A, 12B can comprise a plurality of sharpened points 18A, 19A, 18B, 19B, Meaning, the first defensive protrusion 12A comprises a first sharpened point 18A and a second sharpened point 19A and the second defensive protrusion 12B comprises a first sharpened point 18B and a second sharpened point 19B. In various implementations, the arrangement and design of the various defensive protrusions 12A, 12B can comprise a plurality of sharpened points 18A, 19A, 18B, 19B can contribute to the overall aesthetic features of the bracelet 10.

As shown in FIGS. 6A-B, in alternate embodiments, the various defensive protrusions 12A, 12B can have protrusion openings 50A, 50B, which can provide aesthetic and functional advantages, such as reduced weight.

In the implementation of FIG. 7, the bracelet 10 has a wearable portion 14 that has a cuff-style wrist strap 14B. The body 16 in this implementation is M-shaped, and configured to have defensive protrusions 12A, 12B and a central recession 20 on a first side and two adjacent recessions 52, 54 on the opposite side, so as to accommodate the user's fingers 42, 44, 46. In the implementation of FIG. 7, in use, the user would place their middle finger 42 in the central recession 20, and the index finger 44 and ring finger 46 in the first adjacent recession 52 and second adjacent recession 54, respectively. According to further embodiments, the central recession is ergonomically shaped to conform to the shape of the user's finger.

Although the disclosure has been described with reference to preferred embodiments, persons skilled in the art will recognize that changes may be made in form and detail without departing from the spirit and scope of the disclosed apparatus, systems and methods.

What is claimed is:

1. A self-defense bracelet comprising:

a. an ornamental body comprising:

i. a first defensive protrusion comprising a first sharpened point;

ii. a second defensive protrusion comprising a second sharpened point;

iii. a central recession disposed between the first and second defensive protrusions;

iv. a first adjacent recession disposed opposite the first defensive protrusion; and v. a second adjacent recession disposed opposite the second defensive protrusion; and b. a wearable portion disposed adjacent to the first and second defensive protrusions, wherein the self-defense bracelet is configured to be selectively positioned between a wearable position and a defensive position.

2. The self-defense bracelet of claim 1, wherein the central recession, first adjacent recession and second adjacent recession are configured to accommodate the fingers of the user in the defensive position.

3. The self-defense bracelet of claim 2, wherein the wearable portion is a cuff.

4. The self-defense bracelet of claim 2, wherein the ornamental body is substantially M-shaped.

5. The self-defense bracelet of claim 2, wherein the wearable portion is a strap.

6. The self-defense bracelet of claim 2, wherein the ornamental body is substantially bow-shaped.

* * * * *